US007048164B2

(12) United States Patent
Favre-Bulle et al.

(10) Patent No.: US 7,048,164 B2
(45) Date of Patent: May 23, 2006

(54) SETTING DEVICE

(75) Inventors: Bernard Favre-Bulle, Vienna (AT); Mario Scalet, Schaan (LI); Gebhard Gantner, Nenzing (AT)

(73) Assignee: Hilti Aktiengesellscaft, Schaan (LI)

( * ) Notice: Subject to any disclaimer, the term of this patent is extended or adjusted under 35 U.S.C. 154(b) by 0 days.

(21) Appl. No.: 10/869,418

(22) Filed: Jun. 16, 2004

(65) Prior Publication Data

US 2005/0001000 A1 Jan. 6, 2005

(30) Foreign Application Priority Data

Jun. 17, 2003 (DE) ..... 103 27 191

(51) Int. Cl.
*B25C 1/14* (2006.01)

(52) U.S. Cl. ..... 227/2; 227/10; 227/131; 92/5 R

(58) Field of Classification Search ..... 227/2–4, 227/10, 16, 119, 130, 131, 142, 156; 91/1; 92/5 R See application file for complete search history.

(56) References Cited

U.S. PATENT DOCUMENTS

| | | | | |
|---|---|---|---|---|
| 4,756,229 | A * | 7/1988 | Drakeley | 91/1 |
| 4,883,150 | A * | 11/1989 | Arai | 188/289 |
| 5,287,630 | A * | 2/1994 | Geisler | 33/706 |
| 5,952,823 | A * | 9/1999 | Nyce et al. | 324/207.13 |
| 6,401,883 | B1 * | 6/2002 | Nyce et al. | 188/266 |
| 6,679,410 | B1 * | 1/2004 | Wursch et al. | 227/2 |
| 6,796,477 | B1 * | 9/2004 | Chen | 227/2 |
| 6,834,574 | B1 * | 12/2004 | Neumann | 91/1 |
| 6,940,276 | B1 * | 9/2005 | Shafiyan-Rad et al. | 324/207.22 |
| 2003/0015088 | A1 * | 1/2003 | Wursch et al. | 89/1.14 |

* cited by examiner

*Primary Examiner*—Louis K. Huynh
*Assistant Examiner*—Thanh Truong
(74) *Attorney, Agent, or Firm*—Abelman, Frayne & Schwab

(57) ABSTRACT

The present invention is directed to a combustion-operated setting device for driving fastening elements such as nails, bolts and pins into a substrate, with a setting mechanism comprising a driving piston (15) which is supported to be displaceable in a guide, and with an electronic monitoring device for monitoring the status of the setting device. At least one sensor array (21, 22) is arranged at the guide for generating a measurement data pattern which can be evaluated by the monitoring device.

14 Claims, 7 Drawing Sheets

SETTING DEVICE

BACKGROUND OF THE INVENTION

The present invention is directed to a setting device for driving fastening elements such as nails, bolts and pins into a substrate, with a setting mechanism comprising a driving piston displaceable in a guide, and an electronic monitoring device for monitoring the status of the setting device, wherein at least one sensor array is arranged at the guide for generating a measurement data pattern that can be evaluated by the monitoring device. The invention is also directed to a method for detecting wear in wearing parts of a combustion-operated setting device. Setting devices of this kind, particularly combustion-operated setting devices or setting devices operating on compressed air, are used to drive fastening elements into a substrate.

In general, it is desirable in setting devices of this type to make the setting device as user-friendly as possible.

U.S. Pat. No. 6,123,241 discloses a combustion-operated setting device with a monitoring system by which the user is alerted when servicing or maintenance repairs must be carried out on the setting device. For this purpose, the monitoring system has a microprocessor which is connected to a magazine contents sensor at the fastener magazine and to a jam detector for fasteners in the setting device. The jam detector can comprise a transmitter and a receiver which responds to an electrically conducting fastener.

It is, however, disadvantageous in this known solution that wear cannot be detected in wearing parts such as the piston guide, the pin guide, the driving piston or the like. Further, the jam detector can detect the presence of a fastener jam only quantitatively, but cannot determine qualitatively the kind of jam.

SUMMARY OF THE INVENTION

Therefore, it is the object of the present invention to develop a setting device of the type mentioned above which overcomes the known disadvantages and which makes it possible to monitor wear in the most common wearing parts and which supplies qualitative information about the type of wear and about possible operating malfunctions. This object is met by a setting device for driving fastening elements such as nails, bolts and pins into a substrate, with a setting mechanism comprising a driving piston displaceable in a guide, and an electronic monitoring device for monitoring the status of the setting device. At least one sensor array for generating a measurement data pattern which can be evaluated by the monitoring device is arranged at the guide of the setting device. By this means, the monitoring device receives signals which are not punctiform or binary (yes/no) but rather supply complex spatial information. The sensor array can have sensors in a plurality of planes and the planes can intersect to generate a three-dimensional image.

The guide is advantageously divided into a piston guide and a pin guide, a sensor array being arranged at the pin guide and/or at the piston guide. By this means, wear in the setting piston and the presence or relative position of a fastening element located in the pin guide can be determined simultaneously. There should be at least two sensors for the construction of a sensor array: Good resolution results when there are at least three sensors per sensor array.

It is particularly advantageous when the monitoring device comprises a device for pattern recognition which comprises a data processing unit for comparison of measurement data patterns with stored parameter data patterns of known device states. The stored parameter data patterns of known device states are determined in a learning operation prior to the manufacture of the setting device according to the invention. By means of the device for pattern recognition, the data patterns which are supplied by the sensor array or sensor arrays and which comprise a plurality of sensor signal vectors can be correlated with determined operating states or operating situations based on the learned parameter data patterns. Accordingly, the device for pattern recognition can recognize, e.g., a piston which is worn beyond the maximum allowance and can alert the user of the setting device about this state and switch off the setting device.

Further, a fastening element jam in the pin guide, for example, can be determined quantitatively and described qualitatively.

In an advantageous further development, the device for pattern recognition comprises preamplifier devices by which the signals emitted by the sensors are electronically amplified and conveyed to the A/D converter of the device for pattern recognition in which the measurement data of the sensors which are in analog form are converted into digital data. The A/D converters are connected on the output side to the data processing unit of the device for pattern recognition. A neuronal network for evaluating the measurement data pattern is advantageously emulated in the data processing unit. A very quickly and accurately working monitoring system can be achieved by emulation of the neuronal network in the data processing unit and the processing of digitized data. The neuronal network emulated in the data processing unit, e.g., the microprocessor, has the advantage over an analog neuronal network that the device for pattern recognition occupies relatively little space and that the stored parameters are stable over a long period of time and are not susceptible to interference.

A setting device in which the device for pattern recognition comprises at least one multiplexer in addition to the preamplifier devices and the at least one A/D converter can be manufactured economically, wherein a preamplifier device is associated with a sensor in each instance and the preamplifier devices are connected on the output side to the multiplexer, and wherein the multiplexer is connected on the output side to the A/D converter which is connected on the output side to the data processing unit of the device for pattern recognition.

Further, it is advantageous when the data processing unit has a read-only memory in which the parameter data patterns needed for evaluating and categorizing the measurement data patterns are stored.

In an advantageous variant of the setting device according to the invention, the sensors are constructed as magnetic sensors, wherein at least one magnetic field source such as a permanent magnet or an electromagnet is arranged at the guide. The magnetic sensors pick up a magnetic stray flux which proceeds from the piston or from one or more fastening elements located in the pin guide. The magnetic sensors can be Hall sensors. Sensor arrays of this type comprising magnetic sensors can be realized in a simple manner technologically and result in an economical setting device which can be manufactured relatively advantageously.

In another advantageous variant of the setting device, the sensors are constructed as capacitive sensors. This has the advantage over magnetic sensors in that an electromagnetic magnetic field source need not be provided at the device in addition to a power source.

In a method, according to the invention, for detecting wear in wearing parts of a combustion-operated setting device, sensors of at least one sensor array arranged at the setting device receive measurement signals during the operation of the setting device. These measurement signals are subsequently amplified by preamplifier devices and changed into digital form, optionally with the intermediary of a multiplexer, by the A/D converter or each A/D converter. The measurement signals which are digitized in this way are supplied to a data processing unit, e.g., a microprocessor, in which n signal processing stages, each with a signal distributor, a set of variable gain stages, a set of summing stages and nonlinear amplifier elements are emulated and an artificial neuronal network is generated. The digital measurement signal data are then processed in the signal processing stage. This processing includes the distribution of the measurement signals in the signal distributor, the weighting of the measurement signal data based on stored parameter data patterns from a read-only memory in the variable gain stages and passage of every scaled measurement signal through the summing stages. When more than one signal processing stage (n>1) is provided, the processing is repeated in the following signal processing stage until the final signal processing stage has been run through.

This method, according to the invention, enables evaluation and categorization of complex measurement data patterns virtually in real time, wherein different states of the piston/guide system (e.g., faulty piston state or piston worn beyond the maximum permissible degree, etc.) and/or of the fastening element/pin guide system (e.g., position of the fastening element, type of fastening element, defective fastening element, etc.) can be determined.

Further, it can also be advantageous when the processed measurement signals are changed back into analog form by D/A converters and amplified by output amplifier devices after passing through the final signal processing stage of at least one signal processing stage. Subsequently, the signals can be outputted at adjusting devices, ignition devices, valve devices and/or display devices and used to control the device (e.g., to switch off the setting device) or to convey information about the state of the device to the user of the setting device (e.g., an alert that the piston must be exchanged due to wear).

BRIEF DESCRIPTION OF THE DRAWINGS

Several embodiments of the invention are indicated in the following description with reference to the drawings, wherein.

DETAILED DESCRIPTION OF THE INVENTION

Figure 1:
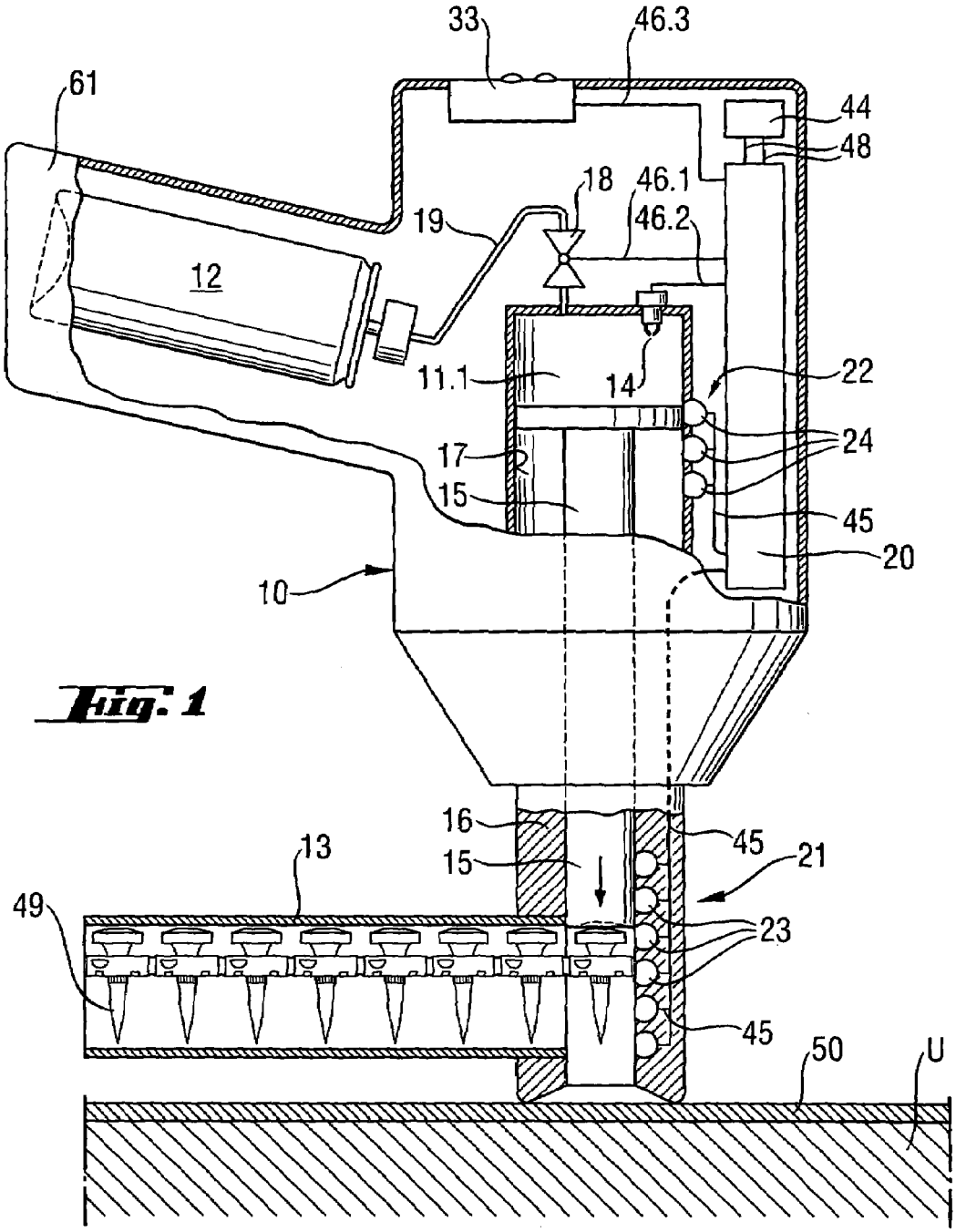
FIG. 1 shows a schematic view in longitudinal section through a setting device according to the invention, which is operated on combustible gas.

FIG. 1 shows a combustion-operated setting device according to the, invention that is pressed against a substrate U upon which a structural component part 50, such as a metal sheet, is to be fastened. The setting device has a housing 10 with a handle 61 formed thereon. Located at the handle 61 is a trigger switch, not shown, by which a setting process can be initiated. Further, the setting device has a combustion chamber 11.1 and a piston guide 17 in which a driving piston 15 is movably guided. Adjoining the piston guide 17 in setting direction is a pin guide 16. A magazine 13 for fastening elements 49 is arranged at the front end of the pin guide 16. A propellant vessel 12 is arranged in the handle 61 of the setting device, particularly in an exchangeable manner, and in the present embodiment example is a vessel for a liquid fuel, e.g., liquid gas, under pressure. The propellant vessel 12 is connected via a fuel feed 19, such as a fuel line, to a valve device 18, e.g., a metering valve, which is connected to the combustion chamber 11.1. Fuel can be introduced into the combustion chamber 11.1 of the setting device via the fuel feed 19 and valve device 18. An ignition device 14 by which an air-fuel mixture located in the combustion chamber 11.1 can be ignited is provided in the combustion chamber 11.1. The valve device 18 and the ignition device 14 are connected by electrical lines 46.1, 46.2 to the control unit and device for pattern recognition 20. Visual signal means 33 are arranged at the setting device to be visible from the outside and electronically contact the control unit and device for pattern recognition 20 via a line 46.3.

A sensor array 22 comprising a plurality of sensors 24, which in this case are constructed as capacitive sensors, is arranged at the piston guide 17 of the setting device. The sensors 24 communicate electronically with the control unit and device for pattern recognition 20 via a data line 45. Further, another sensor array 21 is arranged at the pin guide 16 of the setting device and likewise comprises a plurality of sensors 23 which are constructed as capacitive sensors. The sensors 23 communicate electronically with the control unit and device for pattern recognition 20 via the data line 45.

The control unit and device for pattern recognition 20, in cooperation with the sensor arrays 21 and 22, serve for the detection and evaluation of wear in the area of the piston guide 17, pin guide 16, and driving piston 15 and are correspondingly used to determine the functioning of the setting device before every setting process. Further, the position and orientation of a fastening element in the pin guide is automatically determined quantitatively and qualitatively. The sensor arrays in the present example comprise three sensors 24 for sensor array 22 and six sensors 23 for sensor array 21. The upper limit for sensors per sensor array 21, 22 is typically about 100 sensors. Correspondingly high sensor densities can be realized, e.g., by means of microstructured semiconductor elements. In the present example, the sensors 23, 24 are formed as capacitive sensors.

Figure 2A:
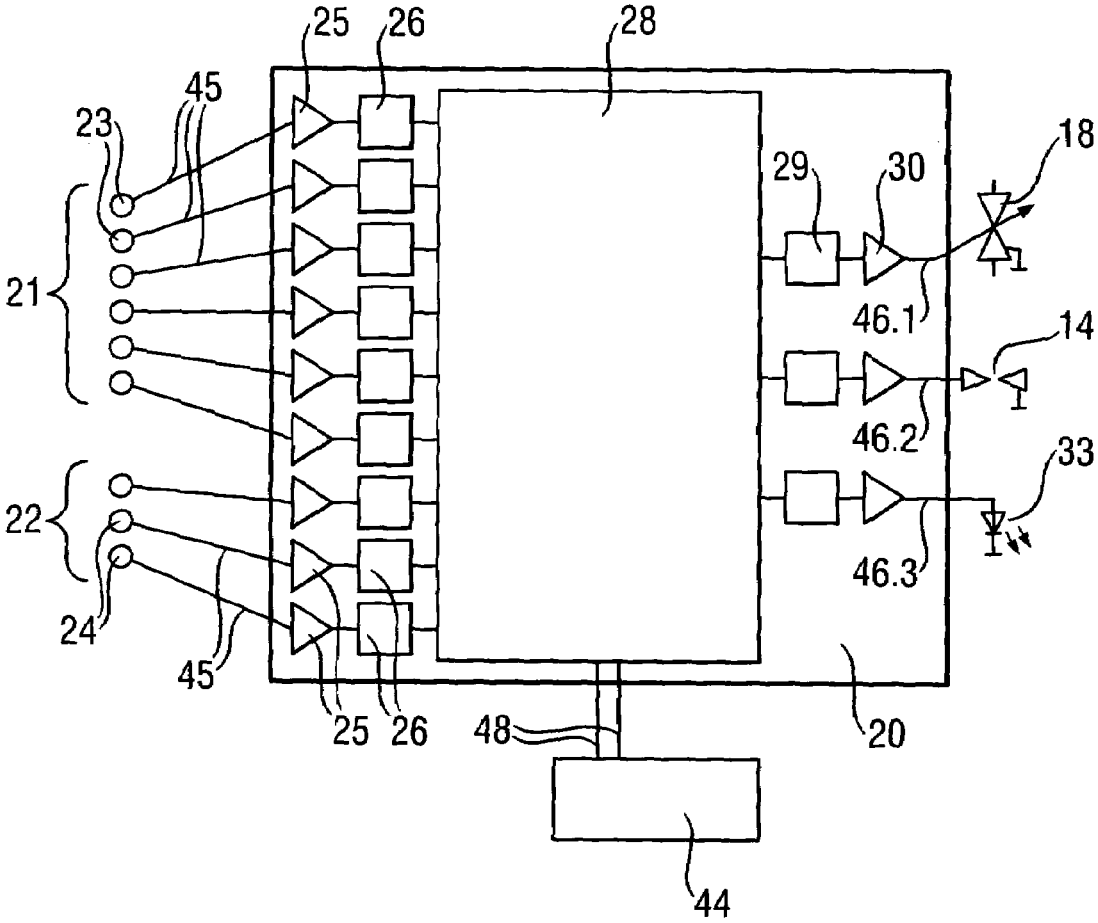
FIG. 2 is a schematic wiring diagram of the setting device of FIG. 1.
FIG. 2*b* shows an alternative schematic wiring diagram of the setting device of FIG. 1.

FIG. 2*a* shows a highly schematic wiring diagram of the setting device of FIG. 1. As can be seen, preamplifier devices 25 are arranged on the input side in the control unit and device for pattern recognition 20. These preamplifier devices 25 are connected to the sensors 23, 24 of the sensor arrays 21, 22 by the line 45. The signals emitted by the sensors 23, 24 are amplified in these preamplifier devices 25 during the operation of the setting device. Each of the preamplifier devices 25 is connected on the output side to an A/D (analog/digital) converter 26. The analog signals or signal data from the sensors 23, 24 are converted into digital data in the A/D converters 26. The data in digital form are then fed into a data processing unit 28, e.g., a microprocessor, for further processing.

Figure 2B:
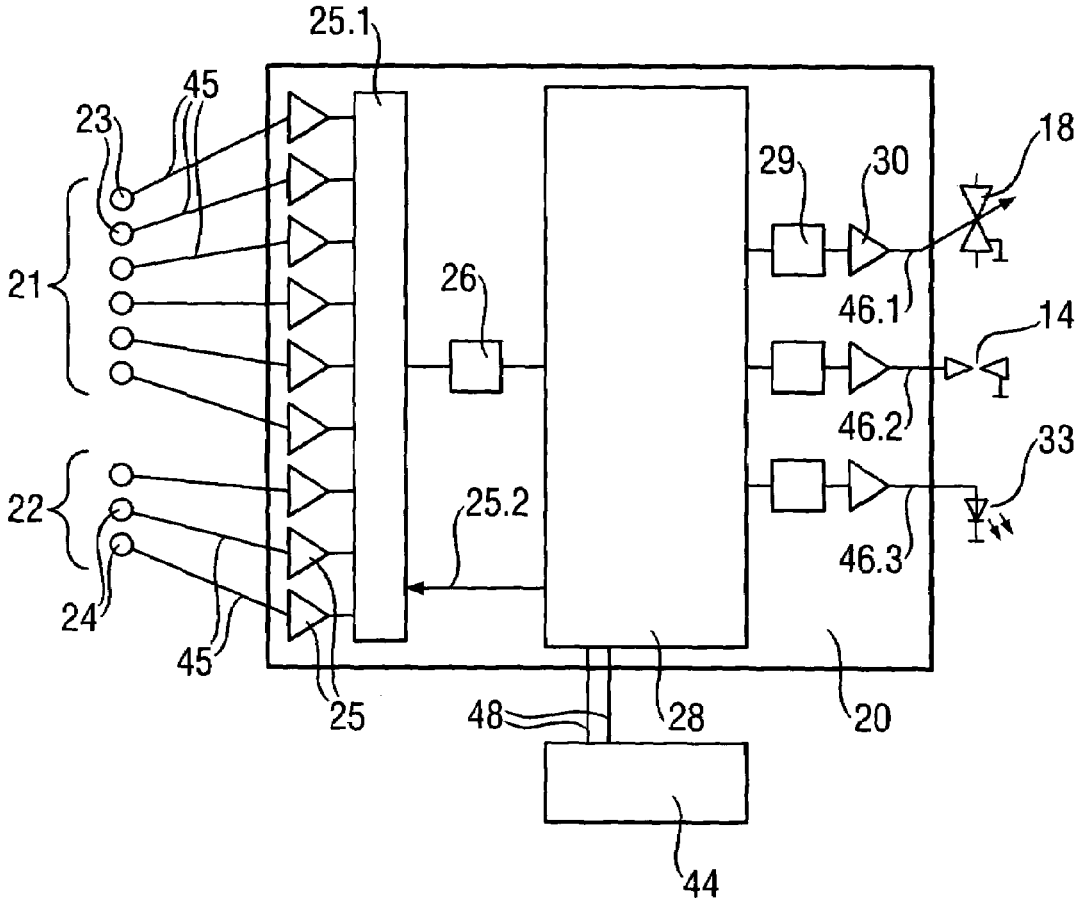

As can be seen from the alternative wiring diagram in FIG. 2*b*, a multiplexer 25.1 which feeds the signals from the preamplifier devices to an individual A/D converter 26 can be arranged downstream of the preamplifier devices. The multiplexer 25.1 is controlled by the data processing unit 28 or microprocessor via line 25.2.

The data processing unit 28 from FIGS. 2*a* and 2*b* is connected at the output side to D/A (digital/analog) converter 29 which converts the output data from the data processing unit 28 into analog signals again. These output signals or control signals of the data processing unit 28 are converted into analog control signals by output amplifier devices 30 downstream of the D/A converter 29. These analog control signals are conveyed to the valve device 18, the ignition device 14 or the signal device or signal devices 33 via lines 46.1, 46.2, 46.3. A power source 44, e.g., a battery or storage battery, is provided for supplying electrical power to the entire system and is connected via electric lines 48 to the control unit and device for pattern recognition 20 and, if need be, to other electrical devices of the setting device.

Figure 3:
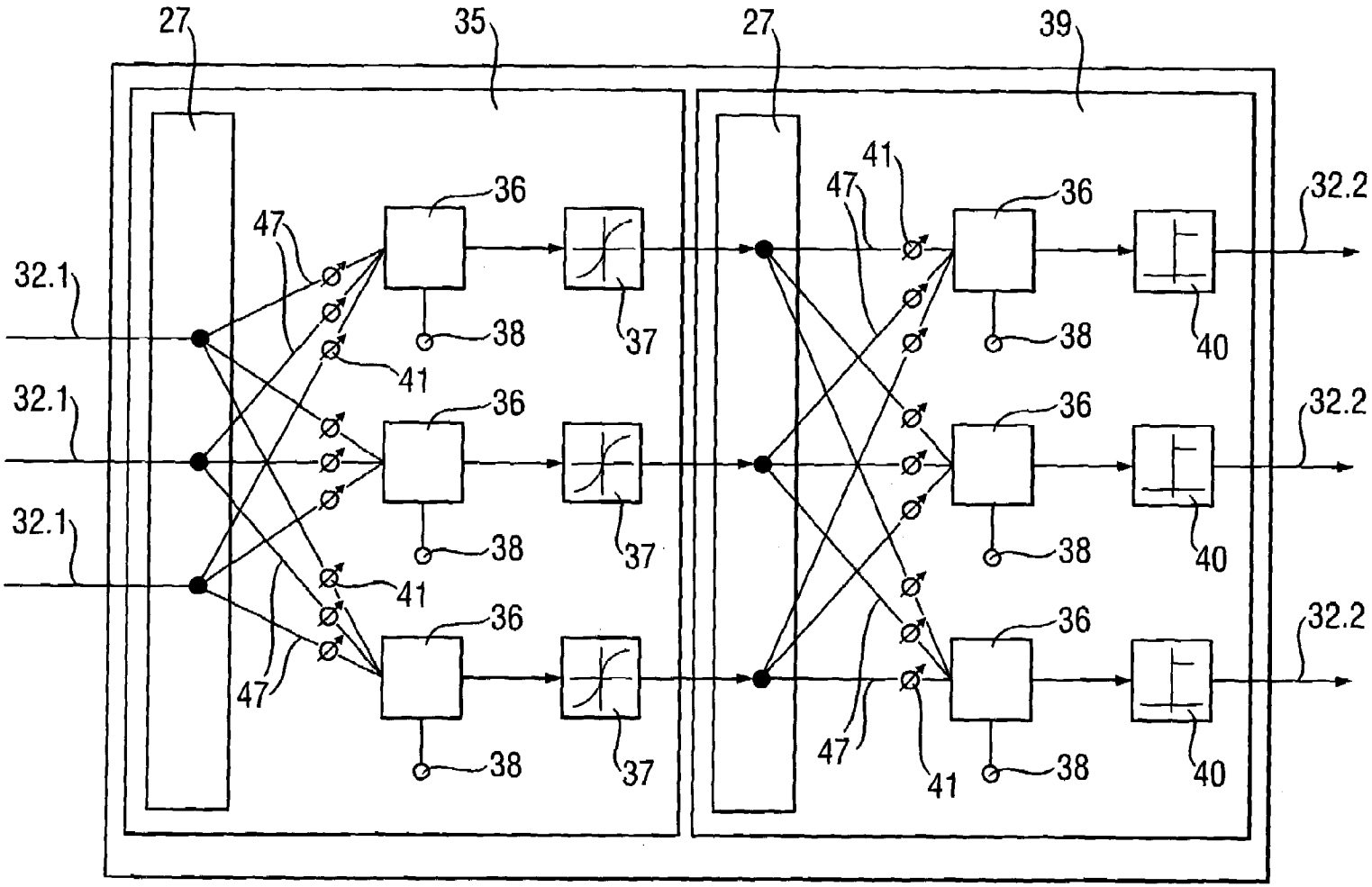
FIG. 3 is a schematic illustration of the operating principle of the device for wear detection of the setting device of FIG. 1.

An artificial neuronal network shown schematically in FIG. 3 is emulated in the data processing unit 28 or microprocessor. A signal distributor 27 which receives the signals from the A/D converters 26 via line 32.1 is first emulated in the data processing unit 28. Two signal-processing stages 35 and 39, each of which has a signal distributor 27 followed by summing stages 36, are provided in the data processing unit 28 shown here.

A plurality of summing stages 36 are assigned to each signal by the signal distributor 27 as is indicated by lines 47. In so doing, variable gain stages 41 are associated with the measurement signals, these variable gain stages 41 carrying out a weighting of the measurement signal data based on stored parameter data patterns from a read-only memory, not designated separately, of the data processing unit 28. After this weighting and after the signals pass through the summing stage 36, the measurement signal data are amplified in nonlinear amplifier elements 37, 40. This evaluation takes place in an identical manner in every signal processing stage 35, 39. The offset input elements 38 constitute a constant signal input for the respective summing stage 36. During the learning process, the offset signal values are changed analogous to the weighting parameters of the learning algorithm until optimal operation is achieved.

As is indicated by the arrow 32.3, the resulting digital signals are conveyed to the output-side D/A converters 29 from the nonlinear amplifier elements 40 of the final signal processing stage 39. As was already described above, the output signals from the D/A converters 29 are conveyed to the output amplifier devices 30 and from the latter to devices 14, 18, 33, etc. for controlling the same.

The stored parameter data patterns in the read-only memory of the data processing unit 28 were determined in a learning operation of a setting device. In this learning operation, data pairs were progressively offered to the neuronal network emulated in a data processing unit. These data pairs comprised known signal patterns, e.g., typical fastening elements in typical positions in the pin guide, in various stages worn driving pistons, piston guides in perfect condition and in a defective state. The parameter data patterns are then adjusted by the neuronal network until the desired output categorization, i.e., the desired output signal, is adjusted at the output of the data processing unit 28 for each of the different states. For example, a warning signal is to be emitted by the signal means 33 which alerts the user of the device, for example, about a defective or worn driving piston and, further, the ignition unit 14 is to be blocked by the corresponding signal output of the data processing unit so that it is no longer possible to continue working with the device.

This process of categorizing must typically be repeated until all of the desired categorizing functions are learned. An automated error descent method is advantageously used to adjust the parameter data pattern followed by minimization of the square error according to known algorithms, e.g., the Levenberg-Marquart algorithm.

Figure 4:
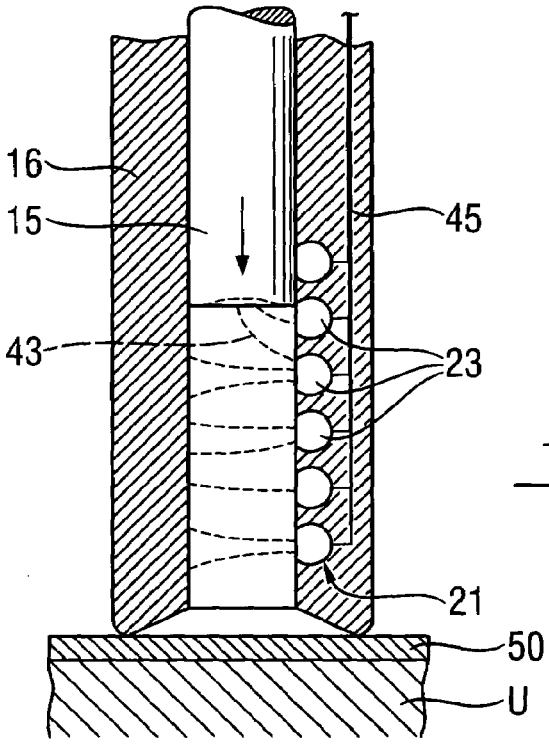
FIG. 4 is a schematic view of the pin guide of the setting device of FIG. 1, in longitudinal section without a fastening element.
Figure 5:
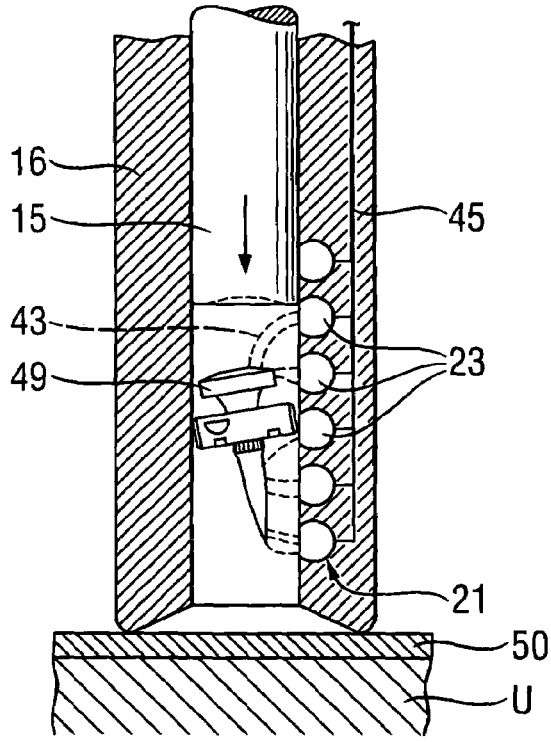
FIG. 5 is a schematic view in longitudinal section through the pin guide of the setting device of FIG. 1 with a fastening element tilted therein.

FIGS. 4 and 5 show the pin guide of the setting device of FIG. 1 without (FIG. 4) and with (FIG. 5) a tilted fastening element located therein. As can be seen from the drawings, a determined pattern of lines of electric flux is picked up by the capacitive sensors 23, leading to characteristic measurement signal data or measurement signal patterns of the sensors 23. These patterns of lines of electric flux 43 differ in a characteristic manner for each fastening element or for each fastening element 49 which is incorrectly positioned in the pin guide. These characteristic signal patterns are detected by the control unit and device for pattern recognition 20 according to the invention (see FIGS. 1 to 3) and are converted into corresponding control signals.

Figure 6:
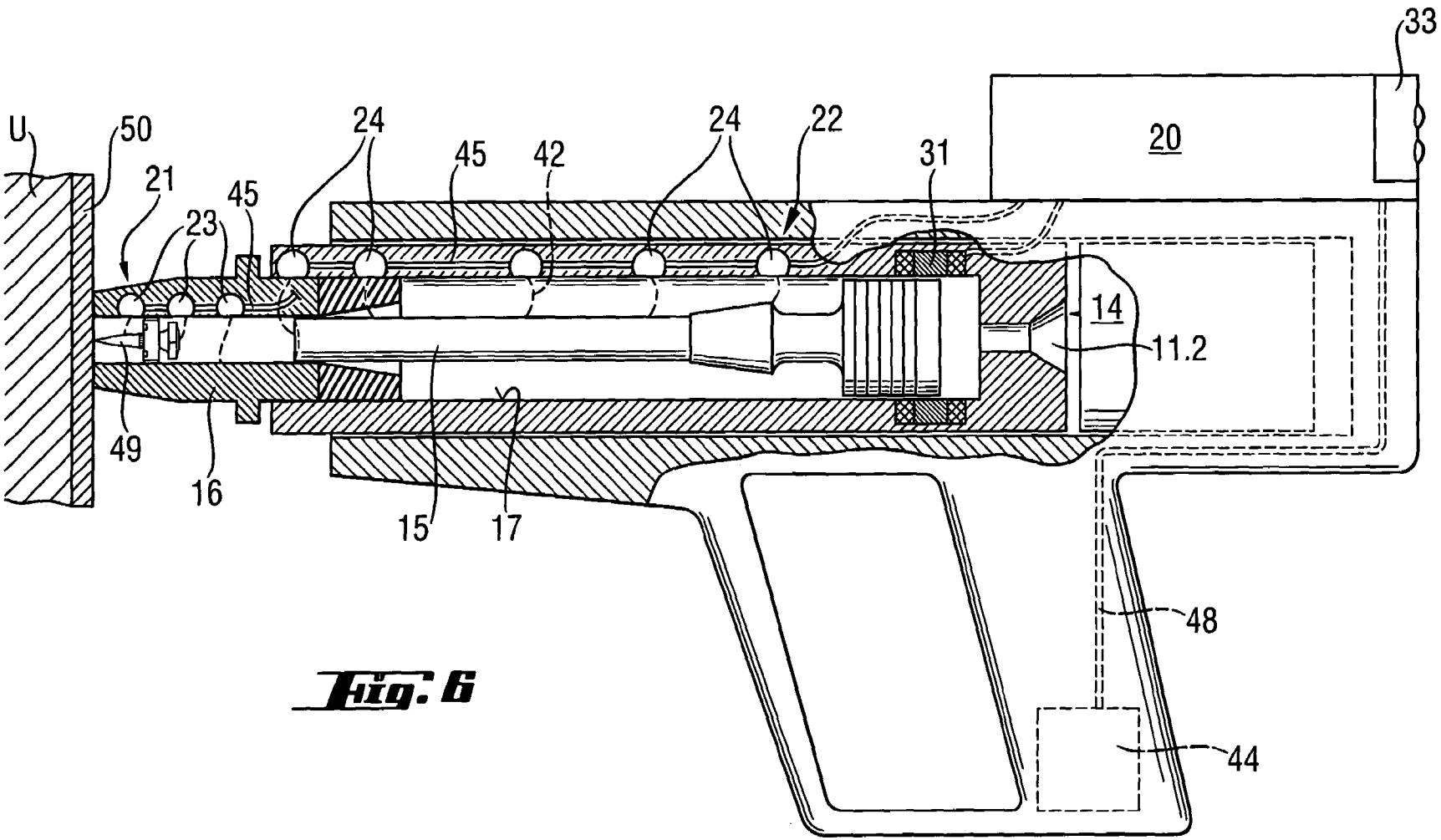
FIG. 6 shows a schematic view in longitudinal section through another setting device operated on combustible gas according to the invention.
Figure 7:
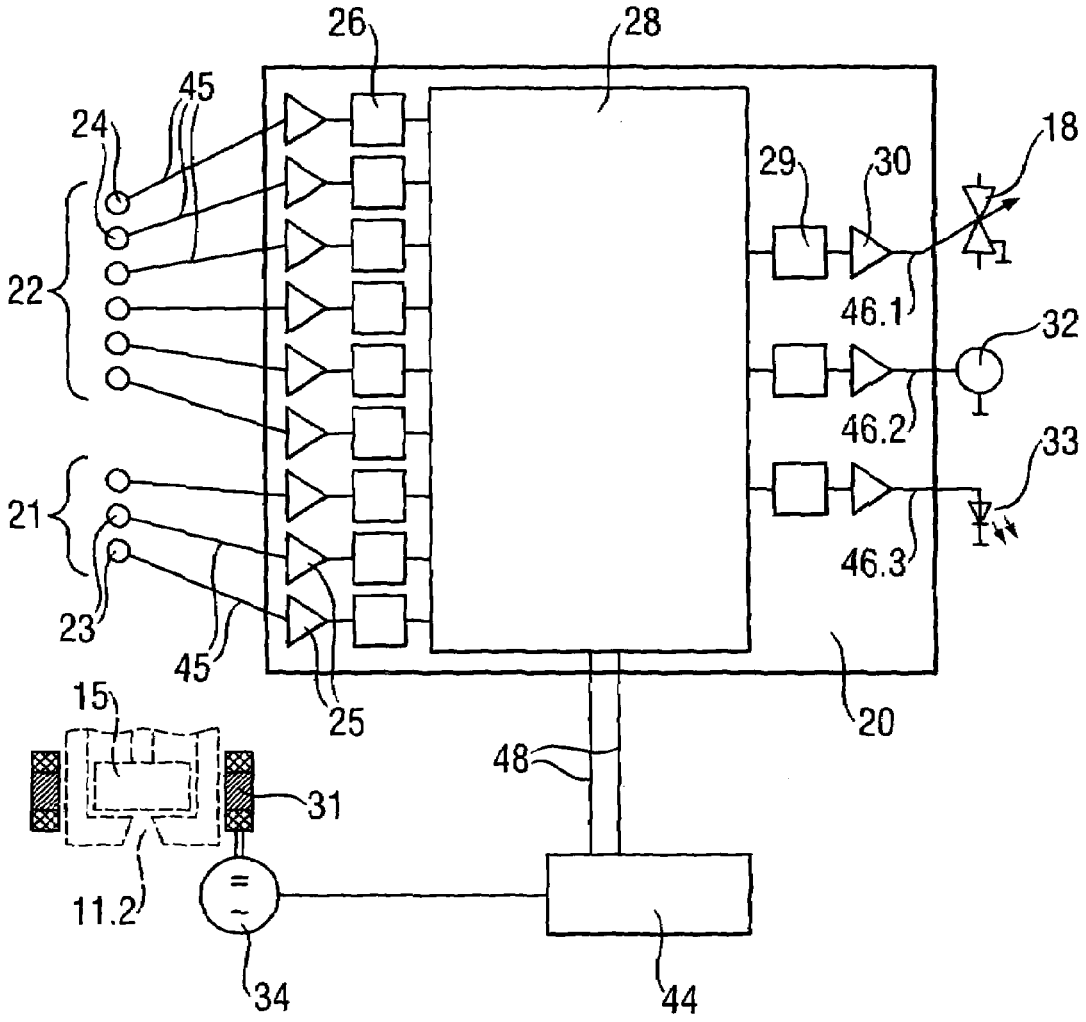
FIG. 7 shows a schematic wiring diagram of the setting device of FIG. 6.

FIGS. 6 and 7 show another powder-operated setting device according to the invention. The setting device shown in FIG. 6 differs from the setting device described above in that the two sensor arrays 21 and 22 are provided with magnetically operating sensors 23, 24, e.g., Hall sensors. The control unit and device for pattern recognition 20 substantially correspond to the control unit and device for pattern recognition that were already described. Magnetic field sources 31, e.g., electromagnets, are arranged in the rear area of the piston guide 17 in which the driving piston 15 is in its initial position, i.e., near the cartridge storage 11.2. A stray flux 42 is generated by these magnetic field sources 31 and is picked up to varying degrees by the sensors 24 and 23 of the sensor arrays 22, 21. The measurement signal data obtained on the basis of the varying stray flux 42 are fed to the control unit and device for pattern recognition 20 for evaluation in a manner similar to that of the evaluating system described above. The wiring diagram shown in FIG. 7 differs from the wiring diagram in FIG. 2*a*, already described, in that a generator device 34 which provides the magnetic field source 31, particularly the electromagnets, with a specific DC current or AC current is provided for a magnetic field source 31. Further, actuating means 32 are provided at an output of the control unit and device for pattern recognition 20. In powder-operated setting devices, output regulation is carried out by means of these actuating means 32 in that the actuating means influence the starting position of the piston or a choke at the exhaust of the setting device. Reference is made to the full description of FIGS. 1 to 5 to avoid repetition.

What is claimed is:

1. A setting device for driving fastening elements such as nails, bolts and pins into a substrate, with a setting mechanism comprising:

a piston guide, a driving piston (15) being supported to be displaceable in the piston guide, an electronic monitoring device for monitoring wear and other possible malfunctions in the piston guide of the setting device, and at least one sensor array (21, 22) arranged at the piston guide for generating a measurement data pattern and connected with the electronic monitoring device for communicating the measurement data pattern thereto, wherein the electronic monitoring device evaluates the measurement data pattern to determine the wear and other possible malfunctions in the piston guide of the setting device.

2. The setting device of claim 1, wherein the piston guide (17) further comprising a pin guide (16), wherein the sensor array (21, 22) is arranged substantially adjacent to at least one of the pin guide (16) and the piston guide (17).

3. The setting device of claim 1, wherein the sensor array (21, 22) comprises at least two sensors (23, 24).

4. The setting device of claim 3, wherein the sensors (23, 24) are constructed as magnetic sensors, and at least one magnetic field source (31) is arranged at the piston guide.

5. The setting device of claim 3, wherein the sensors (23, 24) are capacitive sensors.

6. The setting device of claim 3, wherein the sensor array (21, 22) comprises three sensors.

7. A setting device for driving fastening elements such as nails, bolts and pins into a substrate, with a setting mechanism comprising:

a guide, a driving piston (15) being supported to be displaceable in the guide, an electronic monitoring device for monitoring the status of the setting device, and at least one sensor array (21, 22) arranged at the guide for generating a measurement data pattern and connected with the electronic monitoring device for communicating the measurement data pattern thereto, wherein the electronic monitoring device evaluates the measurement data pattern to determine the status of the setting device, and wherein the monitoring device is a control unit and device for pattern recognition (20) that comprises a data processing unit (28) for comparing measurement data patterns to stored parameter data patterns of known device states.

8. The setting device of claim 7, wherein the device for pattern recognition (20) comprises preamplifier devices (25) and A/D converters (26), wherein a preamplifier device (25) and an A/D converter (26) are assigned respectively to a sensor (23, 24), and wherein all A/D converters (26) are connected on the output side to the data processing unit (28) of the device for pattern recognition (20).

9. The setting device of claim 7, wherein the device for pattern recognition (20) comprises preamplifier devices (25), at least one multiplexer (25.1) and at least one A/D converter (26), wherein each of the preamplifier devices (25) is associated with a sensor (23, 24) and the preamplifier devices (25) are connected on the output side to the multiplexer (25.1), and wherein the multiplexer (25.1) is connected on the output side to the A/D converter (26) that is connected on the output side to the data processing unit (28) of the device for pattern recognition (20).

10. The setting device of claim 9, wherein a neuronal network for evaluating the measurement data pattern is emulated in the data processing unit (28).

11. The setting device of claim 7, wherein the data processing unit (28) has a read-only memory where the parameter data patterns are stored.

12. A setting device for driving fastening elements such as nails, bolts and pins into a substrate, with a setting mechanism comprising:

a guide, a driving piston (15) being supported to be displaceable in the guide, an electronic monitoring device for monitoring the status of the setting device, and at least one sensor array (21, 22) arranged at the guide for generating a measurement data pattern and connected with the electronic monitoring device for communicating the measurement data pattern thereto, wherein the electronic monitoring device evaluates the measurement data pattern to determine the status of the setting device, and wherein the at least one sensor array (21, 22) has a plurality of sensors (23, 24) for receiving measurement signals, and wherein the setting device further comprises a plurality of preamplifier devices (25) for processing the measurement signals and connected with the plurality of sensors (23, 24); an A/D converter (26) operatively connected with the preamplifier devices (25) for converting the processed measurement signals into digital measurement signals; a multiplexer (25.1) arranged between the preamplifier devices (25) and the A/D converter (26) for transmitting the processed measurement signals from the preamplifier devices (25) to the A/D converter (26); a data processing unit (28) for receiving the digital measurement signals and in which n signal processing stages (35, 29), each with a signal distributor (27), a set of variable gain stages (41), a set of summing stages (36, 38) and nonlinear amplifier elements (37, 40) are emulated, with the digital measurement signal data being processed in the signal processing stage (35, 39), including the distribution of the measurement signals in the signal distributor (27), weighting of the measurement signal data based on stored parameter data patterns from a read-only memory in variable gain stages (41), and passage of every scaled measurement signal through summing stages (36, 38), and with $n>1$, the processing is repeated in a following signal processing stage (39).

13. The setting device of claim 12, comprising a plurality of D/A converters (29) for changing the processed measurement signals, after they have passed the final signal processing stage back into analog form, and a plurality of output amplifier devices (30) for amplifying output signals.

14. The setting device of claim 13, comprising at least one of adjusting devices (32), ignition devices (14), valve devices (18) and display devices (33) for receiving an output signal.

* * * * *